United States Patent [19]

Danchak, Jr. et al.

[11] 4,300,756

[45] Nov. 17, 1981

[54] IN-FEED PAPER BUCKLE CONTROL APPARATUS

[75] Inventors: Nicholas Danchak, Jr., Lewisville; Allan L. Saxinger, Denton; Roger M. Gray; Barry C. Kockler, both of Lewisville, all of Tex.

[73] Assignee: Xerox Corporation, Stamford, Conn.

[21] Appl. No.: 128,215

[22] Filed: Mar. 7, 1980

[51] Int. Cl.[3] ..... B65H 7/02

[52] U.S. Cl. ..... 271/8 R; 271/265; 271/275

[58] Field of Search ..... 271/265, 275, 21, 272–274, 271/8 R

[56] References Cited

U.S. PATENT DOCUMENTS

| | | | |
|---|---|---|---|
| 2,377,525 | 6/1945 | Schutt | 271/274 |
| 2,860,875 | 11/1958 | Staeger | 271/21 |
| 3,084,931 | 4/1963 | Hanson | 271/272 X |
| 3,863,913 | 2/1975 | Hirafuji | 271/265 |
| 4,025,187 | 5/1977 | Taylor | 355/14 |

*Primary Examiner*—Richard A. Schacher

[57] ABSTRACT

An automated sheet-feed apparatus for feeding cut sheet paper to an automated printer includes apparatus for forming a predetermined length of buckle in the sheet of paper. The sheet-feed apparatus feeds the leading edge of a sheet of paper into a nip formed by the platen and the first set of pressure feed rollers of the printer. As feeding of the sheet of paper continues, a predetermined length of buckle is formed in the buckle chamber, at which time feeding by the sheet-feed apparatus is stopped. The printer platen drive system feeds the leading edge of the sheet through the nip and to a second nip formed by a second set of pressure feed rollers and the platen before the buckle is eliminated in the sheet of paper, and while the retard force from the sheet-feed apparatus is not apparent to the printer platen drive system.

5 Claims, 4 Drawing Figures

IN-FEED PAPER BUCKLE CONTROL APPARATUS

The present invention relates in general to the feeding of paper into a printer and, more particularly, to the apparatus for controlling the feeding of a sheet of paper into the nip area associated with the platen of the printer to form a predetermined length of buckle in the sheet of paper.

The advent of programmable printing machines, such as automatic typewriters in word processing systems, has been very popular among businesses because of the speed and accuracy with which documents may be prepared. The result of the popularity of the word processing systems has been the creation of a need for more rapid and reliable means of automatically feeding paper to the printers of the systems.

Apparatus and methods for serially feeding discrete pieces of paper to a machine are known in the art. It is also known in the sheet-feeding art that beneficial effects can be obtained by buckling a sheet during the feeding process. Sheet buckling has been employed as a device for improving sheet separation from a stack of sheets as disclosed in U.S. Pat. No. 3,350,089 wherein a sheet is first fed rearwardly against a stop member to form a buckle to separate it from the next adjacent sheet of the stack and then fed forwardly along the feed path.

As disclosed in U.S. Pat. No. 3,292,923, a buckle is introduced into a sheet of paper to allow for any driving speed differences between feed means in separate and associated machines handling the paper.

Since it has been found that the buckle in different kinds of sheets does not necessarily form at the same point in the sheet during feeding, a sensing and adjustable timing means is disclosed in U.S. Pat. No. 4,025,187 to assure a proper buckle in the sheet to reduce any skew.

In all these prior art sheet-feed machines, the amount of force available to pull or feed the sheet along the desired path has not been a problem. When a low-cost sheet feeder is employed in conjunction with a conventional printer in an automatic typewriter, the amount of force available to feed the paper through the printer may be of concern since reliability of proper paper feed and alignment during automatic printing is a high priority. Normally the platen of the automatic printer provides the force required to pull the sheet of paper from the paper feeder, and the force available is limited.

The invention as claimed is intended to provide a remedy for unreliable paper feed when the available force supplied by the platen and feed rollers of the automatic printer is limited. It also provides a remedy for any skewing of the sheet as it is fed to the platen by the sheet feeder.

The invention provides reliable paper feeding to the automatic printer thereby increasing the throughput of the system by reducing delays caused by paper jams and improperly fed sheets. Available printers do not need to be modified to increase the torque available to the platen-drive system.

One means for carrying out the invention is described in detail below with reference to the drawing, which illustrates only one specific embodiment, in which.

Figure 1:
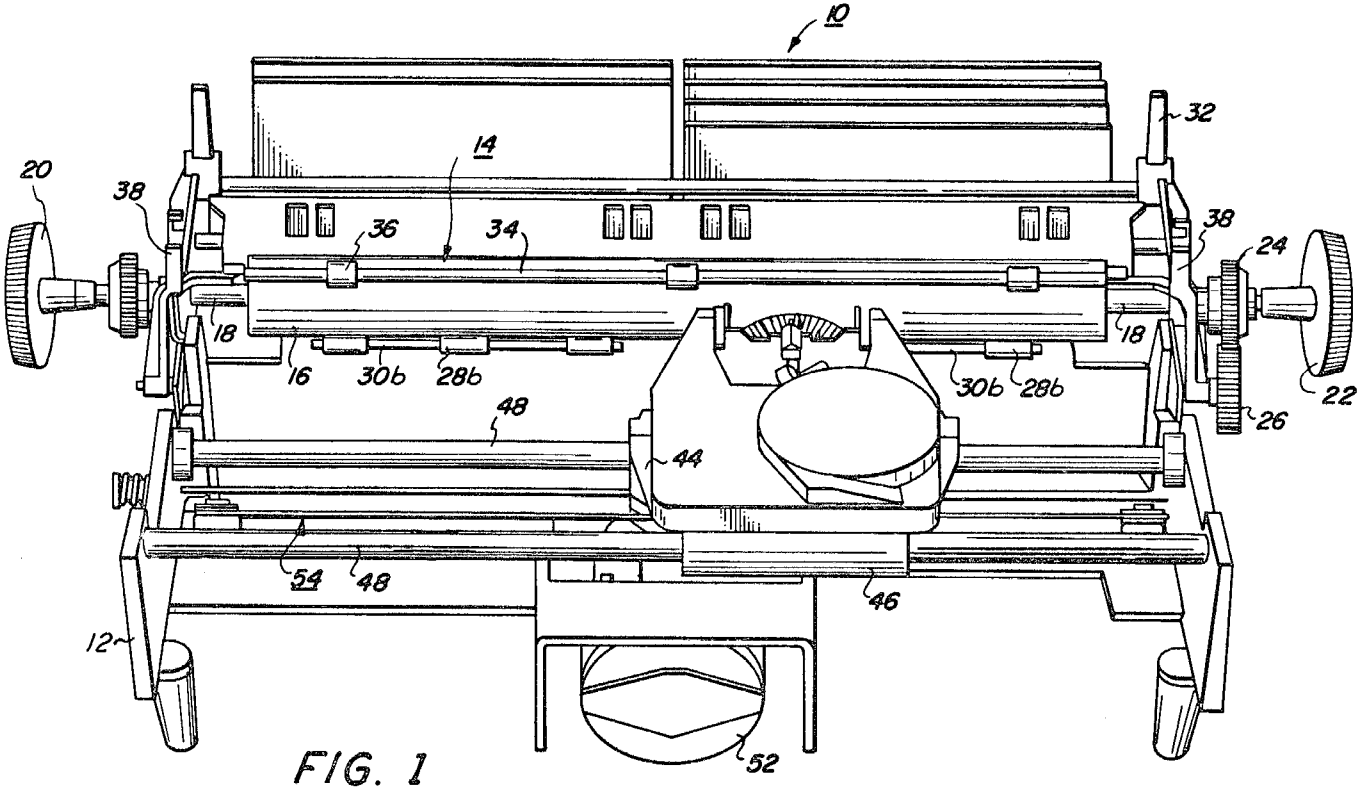
FIG. 1 is a perspective view of a printer of the type used in a word processing system.

Referring now to FIG. 1, an overall view of a printer 10 is illustrated. A platen assembly 14 is mounted to frame 12 for rotation about its axis. The platen assembly 14 includes a platen 16 mounted to a shaft 18 for rotation therewith. The shaft 18 is, in turn, rotatably mounted to the frame 12 and includes a pair of knobs 20 and 22 mounted at respective ends of the shaft for enabling manual controlled rotation of the shaft 18 and platen 16. The knob 20 is fixed to the shaft, and the knob 22 is movable axially of the shaft between first and second positions. When in a first position, a gear-drive assembly 24 mounted about the shaft 18 adjacent the knob 22 is engaged with the shaft so that a motor-gear arrangement 26 (the conventional stepper motor is not shown) coupled to the gear-drive assembly 24 controls the automatic rotation of the shaft 18. When in a second position, the knob 22 disengages the gear-drive assembly 24 from shaft 18 so that manual rotation of the knobs 20 and 22 will cause a corresponding rotation of the shaft 18 and platen 16.

The platen assembly 14 also comprises a plurality of pressure-feed rollers **28*a* and 28*b* (only rollers 28*b* are visible in FIG. 1) connected to one or more lower bail bars 30*a* and 30*b*. By way of example, four bail bars 30*a* and 30*b* are employed (only the front two, 30*b*, are visible in FIG. 1), each bail bar having three rollers rotatably mounted thereon. A spring-biased lever 32 is included in the printer 10 for manual movement between a first or rearward position and a second or forward position. Conventional linkage means (not shown) is provided for maintaining the rollers 28*a* and 28*b* in pressure engagement with the platen 16 when the lever 32 is at its first position and for retracting and holding the rollers 28*a* and 28*b* a predetermined distance from the platen 16 when the lever is moved to its second position. With the rollers 28*a* and 28*b* in pressure engagement with the platen 16, a record material (not shown) may be positively fed through the printer 10 along the platen 16 and past a printing position as the platen 16** is rotated either manually or automatically.

The platen assembly 14 further includes an upper bail bar 34 having a plurality of, e.g., three, follower rollers 36 rotatably mounted thereon. These rollers, when engaged with the platen 16, serve to hold the record material on the platen so that it is directed from the printer 10 in a generally rearward direction. Spring-biased levers 38 are connected to the printer 10 and to the bail bar 34 for maintaining the rollers 36 in pressure engagement with the platen 16 when the levers 38 are in a first or rearward position, and for removing and holding the bail bar 34 and thus rollers 36 a predetermined distance forwardly of the platen 16 when the levers 38 are moved to second or forward position.

Still referring to FIG. 1, the printer 10 also includes a carriage assembly 44 mounted by a pair of bearing members 46 (only one shown) to a respective pair of rods 48, which are mounted at each end of frame 12. A drive motor 52 is coupled by a suitable cable-pulley arrangement 54 to the carriage assembly 44 for imparting linear motion to the carriage assembly 44 along rails 48 in response to rotation of the drive shaft of drive motor 52.

Figure 2:
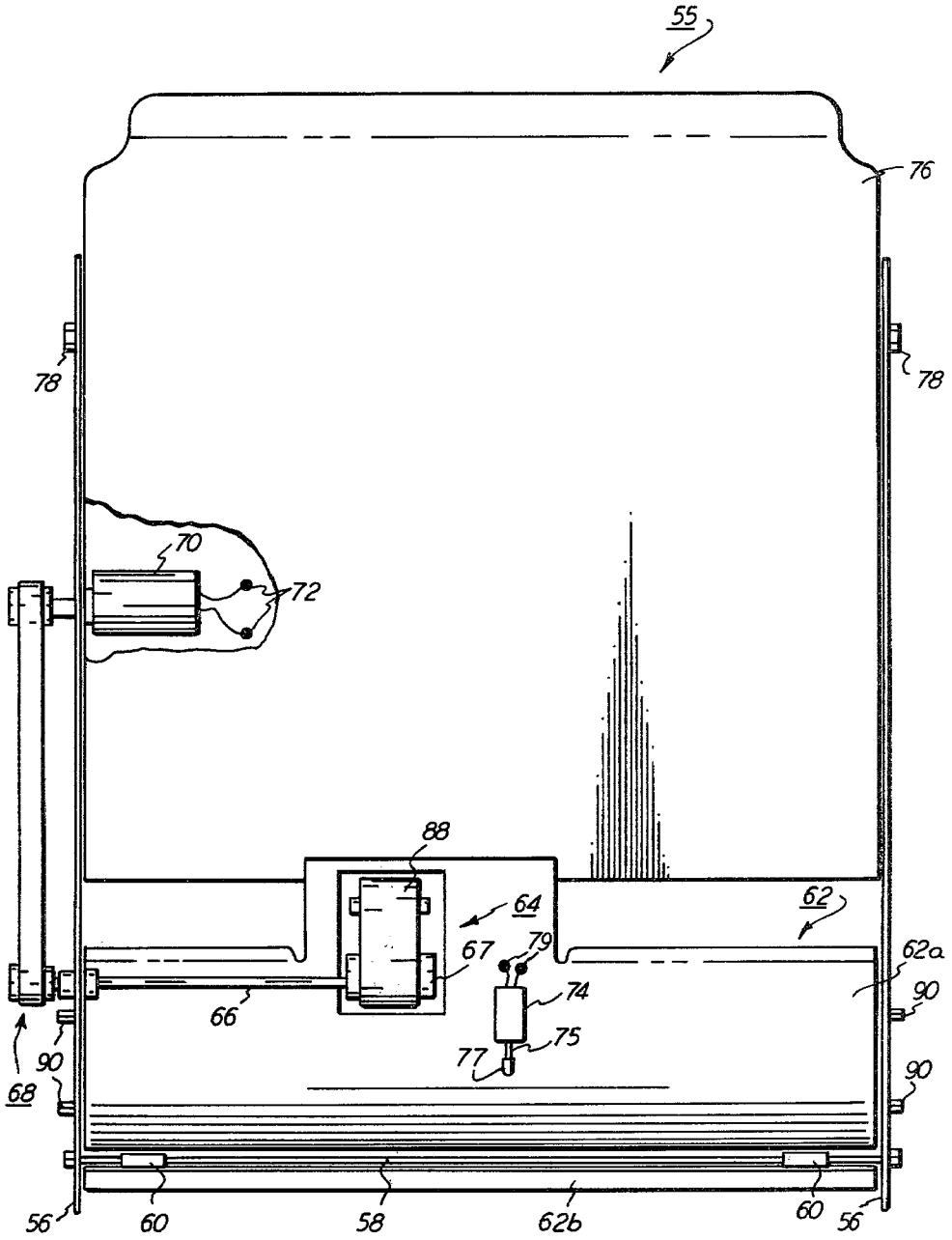
FIG. 2 is a simplified top view of a sheet-feed apparatus embodying the present invention.
Figure 3:
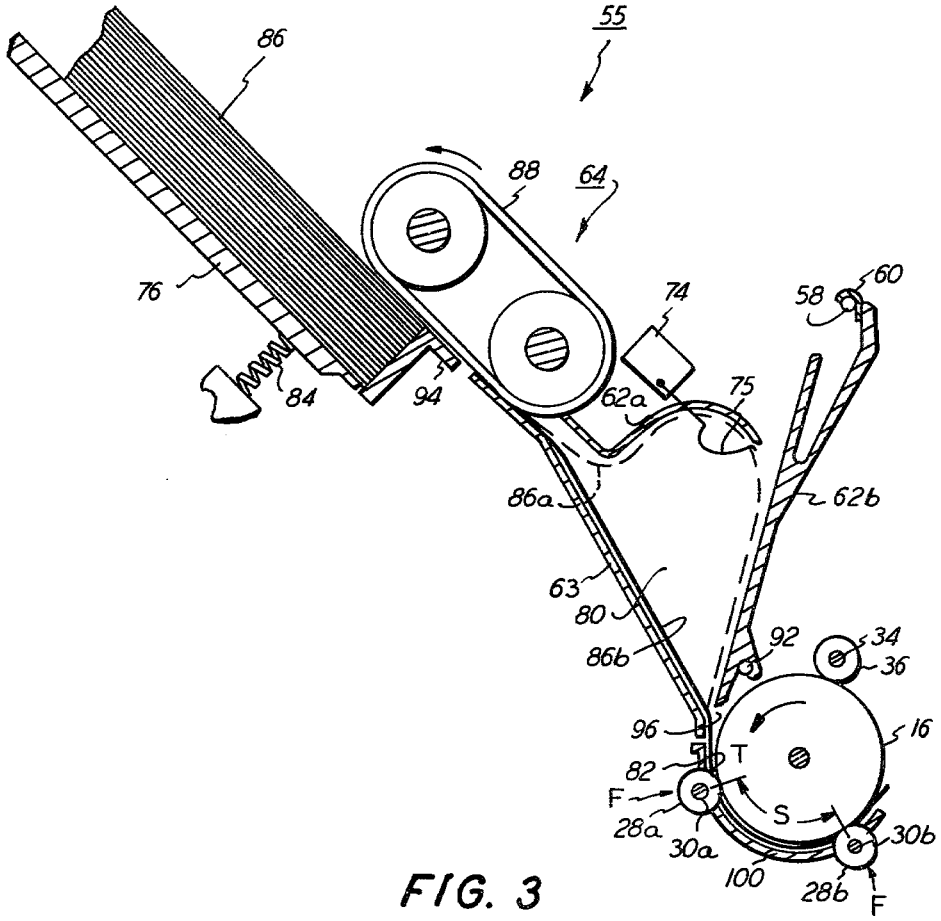
FIG. 3 is a simplified side-sectional view of a sheet-feed apparatus embodying the present invention and the platen paper-feed system of a printer of the type used in a word processing system.

Referring now to FIGS. 2 and 3, a simplified view of a sheet-feed apparatus 55 embodying the present invention is illustrated. Mounted to frame 56 by pivot means 78 in an input paper tray 76. Spring 84 forces the stack of paper sheets 86 against feed belt 88 of paper-feed assembly 64. Sheet 86 could be a single sheet or multiple sheets. Feed belt 88 is driven by stepper drive motor 70 through the pulley-belt assembly 68, shaft 66 and one-way clutch 67. Motor 70 is controlled via signals applied to terminals 72. There are two upper guide plates 62*a* and 62*b;* upper plate 62*a* is stationary, and upper plate 62*b* is pivotable. Plate 62*a* includes a hump-shaped portion in cross section, across the width of plate 62*a,* transverse to the paper-feed path from the paper-feed assembly 64 to the platen 16 to guide the paper 86 during the forming of a buckle in the paper 86. The top edge of plate 62*b* is removably attached to rod 58 by spring clips 60 and is pivoted at the lower portion by pivot means 92. This means of mounting plate 62*b* allows the plate 62*b* to pivot away from the sheet-feed apparatus 55 and upper guide plate 62*a* to provide for clearing of paper jams, etc., from the passageway or buckle chamber 80 formed by plates 62*a* and 62*b*. Plate 62*a* is removably attached to frame 56 by fasteners 90. Buckle sense switch 74 is mounted on upper guide plate 62*a* and positioned such that actuation arm 75 protrudes through opening 77 into the buckle chamber 80. When the buckle sense switch is activated, the signal is transmitted via terminals 79 to the printer electronics circuitry 130 (see FIG. 4).

Referring now to FIG. 3, the relationship between a sheet-feed apparatus 55 embodying the present invention and the platen paper-feed system of a printer is illustrated. Input paper tray 76 pivotably mounted by pivot means 78 and loaded with a stack of paper 86 is rotated by the force of spring 84 such that the top sheet of the stack of paper 86 is maintained in a feeding relationship with feed belt 88 of the paper-feed assembly 64. Separator 94 is positioned with respect to the stack of paper 86 and feed belt 88 such that only one sheet of paper 86 is fed to the printer 10 at any one time. Lower guide plate 63 and upper guide plate 62 define a volume, which forms the passageway or buckle chamber 80, which guides the sheet 86 as it travels from the paper-feed assembly 64 to the platen nip 82. The sheet-feed apparatus 55 is positioned with respect to the platen 16 such that the exit opening or discharge throat 96 formed by the lower edges of the upper guide plate 62 and the lower guide plate 63 guides the leading edge of a sheet of paper 86 leaving the buckle chamber 80 such that the leading edge will enter the platen nip 82. The platen nip 82 is formed by the contact of the platen 16 and pressure feed rollers 28*a*. Feed rollers 28*a* and 28*b* are separated by the distance S along the surface of platen 16.

Once the sheet of paper 86 arrives at the nip 82, the force required to pull the paper 86 from the paper-feed assembly 64 and the separator 94 and overcome the retard force must be provided initially by the platen 16 and pressure feed rollers 28*a*. The pressure feed rollers 28*a* and 28*b* provide a force F by conventional spring means, which is transverse to the surface of the platen 16 at the point of contact. The amount of force to be applied by feed rollers 28*a* and 28*b* is limited because if the force applied is too great, marks will be left on the sheets of paper by rollers 28*a* and 28*b* when multiple sheets with carbons (e.g., multiple sheet forms) are used in the printer. The normal stepper motor (not shown) used to provide the torque T to the platen 16 is usually limited in power. Many of the presently available printers were designed prior to the use of automatic feeding of sheets of paper to the printer.

The force available from the platen 16 and feed rollers 28*a* and 28*b* to pull the paper 86 is applied in two stages. When a sheet of paper 86 is fed into the nip 82, the platen 16 has only a predetermined amount (e.g., one and one-half pounds) of pull force available from the platen 16 and feed rollers 28*a* to apply to the paper 86. The retard force that the separator 94 and the paper-feed assembly 64 apply to the paper 86 can be, in the worst case, greater (e.g., two pounds) than the force available from the platen 16 and pressure feed rollers 28*a*. The force that the separator 94 and the paper-feed assembly 64 apply to the paper 86 varies and is dependent upon the height of the paper stack, the size of the paper and type of paper. Reliable paper feed can be marginal depending upon the values of the two forces applied to the paper. For a given retard force, if the force applied to platen 16 by feed rollers 28*a* is of too small a value, then slippage can occur between the paper 86 and the platen 16 when the platen 16 is rotated. If the force applied to platen 16 by feed rollers 28*a* is of sufficient force so there is no slippage between the paper 86 and the platen 16, the stepper motor that drives the platen 16 may slip poles and cause unreliable paper feed. Once the paper 86 is fed around the feed rollers 28*b,* there is approximately twice the force (e.g., three pounds) available to pull the paper from the separator 94 and the paper-feed assembly 64 and reliable paper feed occurs.

In operation of the specific embodiment employing the present invention, a sheet of paper 86 is fed from the paper-feed assembly 64 and initially into the passageway or buckle chamber 80. As feeding continues, the leading or front edge of the paper 86 contacts the smooth surface of the upper guide plate 62*b* and walks down that surface and references into nip 82. Feeding of the paper 86 continues, buckling of the paper 86 occurs as the paper conforms to the shape of the buckle guide means formed by plates 62*a* and 62*b,* and the actuation arm 75 of buckle sense switch 74 is moved by the paper 86 thereby providing the activation indication over the buckle sense switch output 79 to the printer electronics circuitry 130 (see FIG. 4). The stepper drive motor 70 is driven through a predetermined number of steps (e.g., 16) after the buckle sense switch 74 is activated, and then the stepper drive motor 70 is turned off by the sheet feed electronics 120. The paper-feed assembly 64 has some inertia so the paper 86 will continue to be fed a very small amount (e.g., fraction of an inch) after the stepper drive motor 70 is inactivated. The combination of the size and shape (capacity) of the buckle chamber 80, the positioning of the buckle sense switch 74 and actuation arm 75, the additional predetermined number of steps provided by the stepper drive motor 70 after inactivation and the inertia of the paper-feed assembly 64 ensure a buckle of proper size (length) in the paper 86 and proper registration of the paper 86 in the nip 82, which eliminates any skew in paper 86. (This is shown in dotted line form as 86*a*.) After the operation of the paper-feed system 64 ceases, the stepper motor (not shown) of the printer drives the platen 16 through the motor gear arrangement 26 and the gear drive assembly 24 to feed the paper 86 and move the leading edge of the paper 86 (guided by paper pan 100) to the second set of pressure feed rollers 28*b* and continues to move the paper 86 such that the leading edge of the paper 86 is at desired position and ready for printing to occur. This position is shown in solid line as 86*b* and shows the taut position of paper 86. The buckle in the paper 86 must have been of such length (greater than S) that the separator 94 and the paper-feed assembly 64 do not retard the paper 86 until after the leading edge of paper 86 is positioned under pressure feed rollers 28*b*. A correct buckle in the paper 86 performs three functions: (1) allows the front edge of the paper 86 to be registered to the pressure feed rollers 28*b* without the separator 94 and the paper-feed assembly 64 applying any opposing or retard force to the paper, (2) controls skew in the paper 86 to an acceptable level as it is referenced in the nip 82 and (3) provides proper referencing of the paper 86 in the nip 82 so the platen 16 and the pressure feed rollers 28*a* will pick up the paper 86 and move the paper to pressure feed rollers 28*b*. If the buckle in the paper is of insufficient length, the paper 86 will not be fed in a reliable manner. If the buckle is too large (long), the paper 86 will reverse buckle, and the leading edge of the paper 86 will be pulled from the nip 82, and again the paper 86 will not be fed in a reliable manner.

Figure 4:
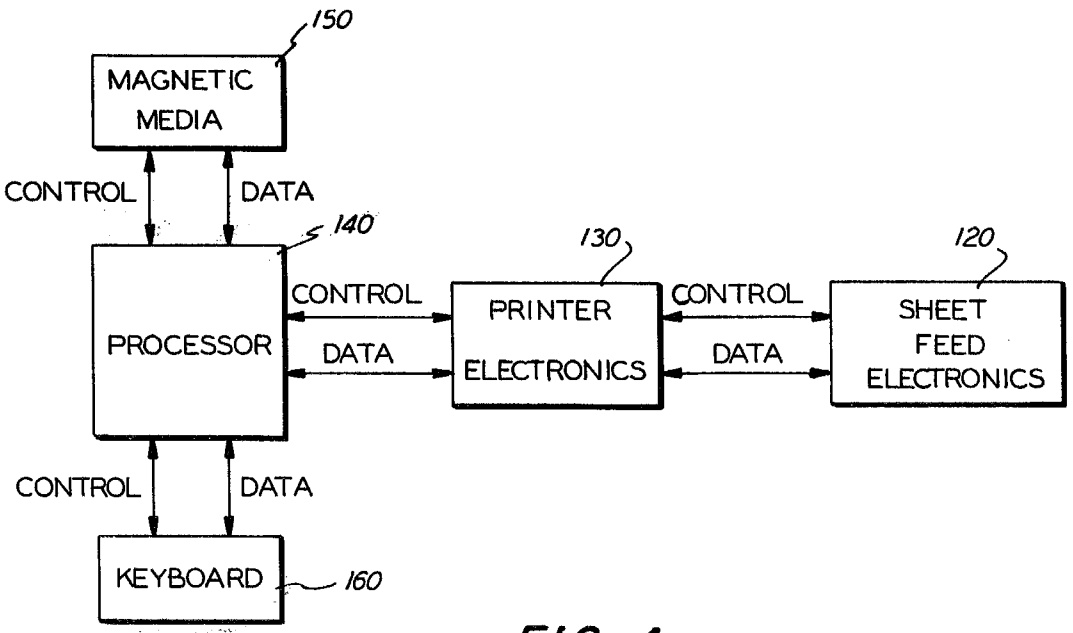
FIG. 4 is a simplified schematic of the electronics controlling the paper-feeding process.

FIG. 4 illustrates in a simplified manner the means for controlling the sheet-feed apparatus 55 and the platen 16 of printer 10. With reference to FIGS. 2–4, the sheet-feed apparatus 55 is controlled as a subsystem of the printer 10 by the printer electronics 130 via the sheet-feed electronics 120. Paper 86 is fed on demand and controlled by the processor 140 via the printer electronics 130. The paper-feed signal from the processor 140 originates either from the keyboard 160 or the program on the magnetic media 150. The paper 86 is fed until the buckle sense switch 74 is activated whereupon the sheet-feed electronics 120 step the stepper drive motor 70 a predetermined number of steps and then inactivate motor 70. Upon receipt of the signal indicating paper feed has stopped, the processor 140 through the printer electronics 130 activates the stepper motor (not shown) to drive the platen 16 to position the paper 86 for normal typing operation and paper removal.

Although the present invention has been described with reference to a presently preferred embodiment, it will be appreciated by those skilled in the art that various modifications, alternatives, variations, etc., may be made without departing from the spirit and scope of the invention as defined in the appended claims.

What is claimed is:

1. A cut-sheet feeding apparatus for use with an independently operable printing machine having a platen and first and second pressure feed roller means positioned in rolling contact with the periphery of said platen and separated from each other by a predetermined distance around the periphery of said platen, said cut-sheet feeding apparatus comprising:

sheet-supply means for storing a plurality of sheet members, sheet-feeding means operatively positioned for feeding sheet members in singular sequence from said sheet-supply means toward said platen, sheet guide means operatively positioned to guide a leading edge of each sheet member, as it exits said sheet-feeding means, to a nip formed by the platen and the first pressure feed roller means, said sheet-guide means including buckle-guide means for forming a buckle of predetermined length and shape into each sheet member after each sheet member has registered into said nip, said predetermined length of buckle being greater than the distance measured on the periphery of the platen between the first and second pressure feed roller means, sensing means operatively positioned with respect to the buckle-guide means to sense the presence of the buckle and operatively connected to the sheet-feeding means to stop operation thereof at a predetermined time.

2. Apparatus as recited in claim 1 wherein said sensing means comprises:

switch means operatively positioned to be triggered by the presence of the buckle formed in the sheet member when the buckle is at a predetermined position, circuit means for receiving an output from said switch means and, after a predetermined amount of feeding of the sheet, for providing an output to the sheet-feeding means to stop operation thereof.

3. Apparatus as recited in claim 1 wherein said sheet-guide means comprises:

a lower plate means, an upper plate means, said upper plate means positioned with respect to said lower plate means to form a passageway for each sheet member from the sheet-feeding means to the nip and cooperating to form a sheet discharge throat at the nip.

4. Apparatus as recited in claim 3 wherein said upper plate means includes a hump-shaped portion in cross section forming said buckle-guide means therein to guide the sheet member into said predetermined buckle length, said buckle-guide means being formed in the upper plate means in a direction transverse to the feed direction of the sheet member.

5. Apparatus as recited in claim 3 wherein said upper plate means includes a stationary member and a pivotal member, said pivotal member being pivotally mounted to said cut-sheet feeding apparatus adjacent said sheet discharge throat whereby said pivotal member may be pivoted away from said lower plate to allow access by an operator to clear a paper jam occurring in said passageway.

* * * * *